United States Patent [19]

Wagner

[11] Patent Number: 4,729,515

[45] **Date of Patent: * Mar. 8, 1988**

[54] MACHINE FOR CUTTING DISPOSABLE CONTAINERS

[76] Inventor: John W. Wagner, 3321 McIntyne Dr., Murrysville, Pa. 15668

[ * ] Notice: The portion of the term of this patent subsequent to Jun. 2, 2004 has been disclaimed.

[21] Appl. No.: 834,968

[22] Filed: Feb. 28, 1986

Related U.S. Application Data

[63] Continuation of Ser. No. 646,917, Sep. 4, 1984, abandoned.

[51] Int. Cl.[4] ..... B02C 19/14

[52] U.S. Cl. ..... 241/99; 241/166; 241/224; 241/236

[58] Field of Search ..... 100/902, 96, 172; 241/99, 236, 166, 167, 36, 37.5, 222, 224, 225, 29; 194/208, 209; 83/500, 501, 502, 503, 504, 345

[56] References Cited

U.S. PATENT DOCUMENTS

| | | | |
|---|---|---|---|
| 1,849,591 | 3/1932 | Rado | 83/500 X |
| 2,048,684 | 7/1936 | Carr | 83/503 X |
| 3,024,720 | 3/1962 | Welsh | 241/99 |
| 3,155,028 | 11/1964 | Morgenson | 100/96 |
| 3,489,354 | 1/1970 | Harper et al. | 241/99 X |
| 3,504,621 | 4/1970 | Qualheim | 100/96 |
| 3,921,920 | 11/1975 | Brocard | 241/236 X |
| 3,960,335 | 6/1976 | Haberle | 241/236 |
| 4,009,838 | 3/1977 | Tashman | 241/99 |
| 4,018,392 | 4/1977 | Wagner | 241/236 X |
| 4,061,278 | 12/1977 | Ehinger | 241/236 X |
| 4,285,426 | 8/1981 | Cahill | 241/99 X |
| 4,625,925 | 12/1986 | Goldhammer | 241/236 |

FOREIGN PATENT DOCUMENTS

| | | | |
|---|---|---|---|
| 2723281 | 12/1978 | Fed. Rep. of Germany | 241/236 |
| 1558423 | 1/1980 | United Kingdom | 241/236 |
| 2091588 | 8/1982 | United Kingdom | 241/236 |

*Primary Examiner*—Mark Rosenbaum

*Attorney, Agent, or Firm*—James L. Sherman

[57] ABSTRACT

A machine is capable of cutting into pieces a plurality of diposable containers such as plastic bottles and metal cans. The machine includes a loading section, a cutting section and a collecting section. The cutting section includes a pair of parallel shafts mounted for rotation in opposite directions. Each of the shafts supports a plurality of cutting wheels keyed for rotation therewith. The cutting wheels of one shaft overlap the cutting wheels on the other shaft as each cutting wheel is axially separated from axially adjacent cutting wheels thereon by one of the cutting wheels on the other shaft. A plurality of combers in aligned with each cutting wheel to provide a gap between the cutting teeth and the end of the comber. The disposable containers are cut between the cutting wheels of one shaft and the cutting wheels of the other shaft with the pieces passing through the gap between the end of the comber and the cutting wheel teeth.

14 Claims, 7 Drawing Figures

MACHINE FOR CUTTING DISPOSABLE CONTAINERS

This application is a continuation of application Ser. No. 646,917 filed Sept. 4, 1984, now abandoned.

BACKGROUND OF THE INVENTION

1. Field of the Invention.

This invention relates to a machine for cutting disposable containers such as plastic bottles or metal cans into small pieces.

2. Description of the Prior Art.

Recent legislation regulating the collection and disposition of disposable containers such as plastic bottles and metal cans in the soft drink industry has resulted in increased interest in machines that can be employed to reduce the size of the used containers to simplify handling and storage. Three machines respectively disclosed in U.S. Pat. Nos. 3,857,334; 4,009,838; and 4,285,426 represent specific devices intended to satisfy specific needs in this regard.

However, there remains a need for any reliable and versatile machine configuration which can be equally employed to cut the sheet plastic or sheet metal material of the disposable containers. Paper shredding machines include a general configuration which might appear to satisfy such a need but would not normally include sufficiently strong components or be properly configured for such a heavy-duty operation. Nevertheless, paper shredding machines such as those disclosed in U.S. Pat. Nos. 1,178,386; 1,319,496; 2,202,843; 2,554,114; 2,770,302; 3,797,765; and 4,018,392, include a general arrangement of rotating cutters and stationary combers which could be appropriate for this purpose. Clearly, the particular components to be used in such a machine should be simple to manufacture and easy to assemble. Further, it would be advantageous if the machine configuration could be employed for any number of purposes, such as within machines to be operated by consumers, machines to be operated by store personnel, or machines to be operated at waste control centers.

SUMMARY OF THE INVENTION

It is, therefore, an object of this invention to provide a machine capable of cutting into pieces a plurality of disposable containers such as plastic bottles and metal cans.

It is another object to provide such a machine with components which are simple to manufacture, easy to assemble and reliable to operate.

It is a further object to provide such a machine with a general configuration which can be employed on different size machines which clearly satisfy different needs.

These and other objects of the invention are provided in a preferred embodiment thereof including a machine capable of cutting into pieces a plurality of disposable containers such as plastic bottles and metal cans. The machine includes a loading section for receiving the disposable containers and a cutting section joined to the loading section at an entrance opening for receiving the containers therefrom. The cutting section includes a pair of parallel shafts mounted for rotation in opposite directions. The pair of shafts each support a plurality of cutting wheels keyed for rotation therewith. The pair of shafts are separated by a distance therebetween which is less than a diameter of the cutting wheels thereon. Each cutting wheel is mounted for axial movement on one shaft and is axially separated from axially adjacent cutting wheels thereon by one cutting wheel on the other shaft extending therebetween. The cutting section includes a plurality of combers which are each aligned with a corresponding cutting wheel to provide a gap between an end thereof and the cutting teeth of the corresponding cutting wheel. The plurality of cutting wheels on the pair of shafts are rotated to grip the disposable containers to be directed between the cutting wheel on one shaft and the cutting wheel on the other shaft as the pieces pass through the gaps between the ends of the combers and the cutting teeth of the corresponding cutting wheel. A collecting section adjoins the cutting section for receipt of pieces of disposable containers leaving the cutting section.

DESCRIPTION OF THE PREFERRED EMBODIMENTS

Figure 3:
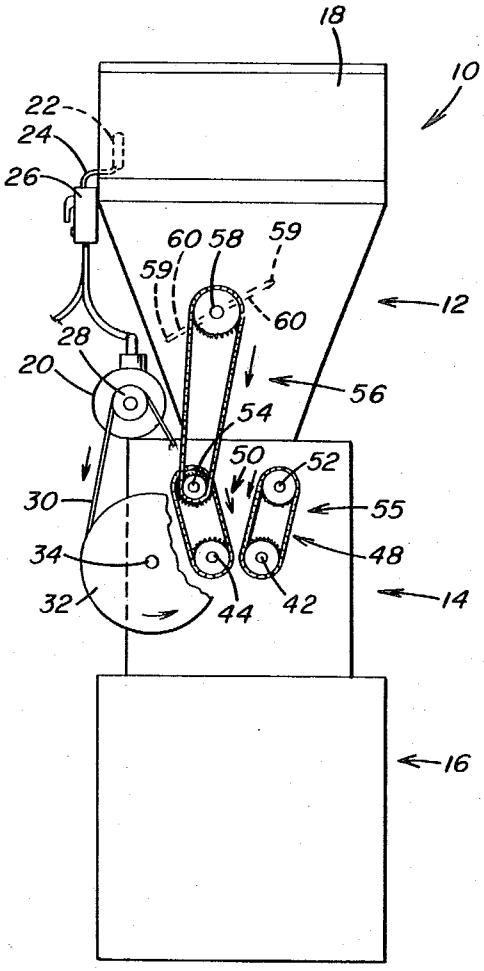
FIG. 3 is an elevational view of the opposite side of the machine in FIG. 1.
Figure 2:
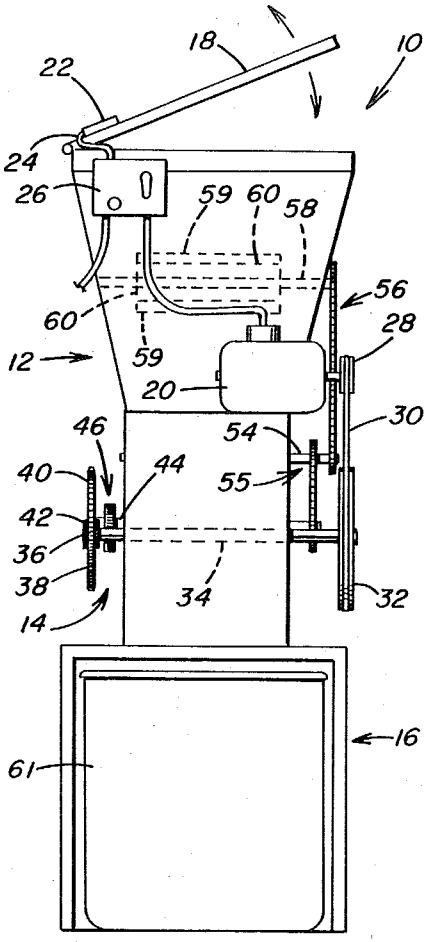
FIG. 2 is a front elevational view of the machine of FIG. 1.
Figure 1:
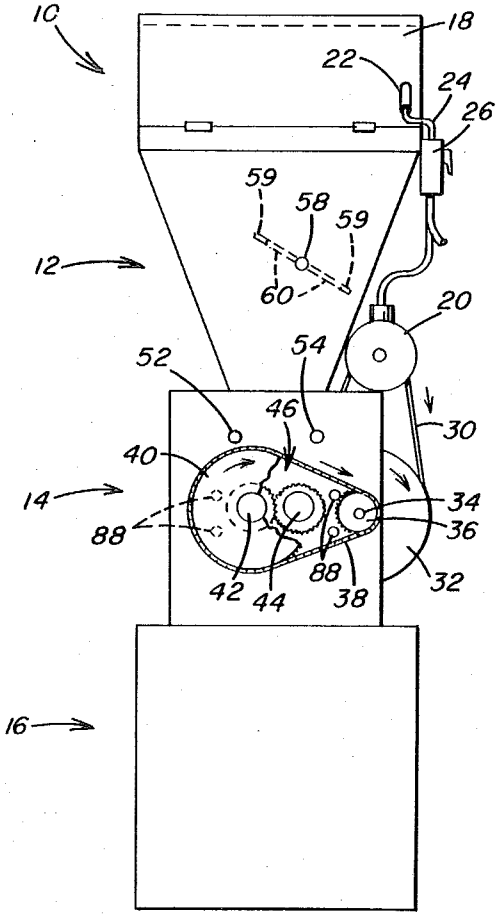
FIG. 1 is a side elevational view of the preferred machine including various features of the invention.

As seen in FIGS. 1, 2 and 3, the preferred machine 10 for cutting disposable containers such as plastic bottles and metal cans primarily includes a loading section 12, a cutting section 14, and a collecting section 16. The preferred machine 10 is the type which can be utilized in grocery or convenience stores to reduce the volume of disposable container material to be handled or sotred by store personnel until removed by waste or scrap dealers. The machine 10, shown without cover panels and shields in order to see various operating components, includes features which are particularly adapted for such a use. For example, it basically employs gravity flow, includes operator accessable loading section 12 and collecting section 16, and incorporates safety features associated with the loading section 12 to ensure against any injury or harm to the operator.

Specifically, the loading section 12 is funnel-shaped and includes a closable top 18 which, when open, allows approximately thirty 2-liter disposable plastic bottles to be put in the interior of the section 12. Operation of the machine motor 20 is prevented whenever the top 18 is open by a safety switch 22 mounted on the top 18. Specifically, the switch 22 is a mercury-type switch which is only closed to allow current to flow therethrough when in a horizontal position. The top 18 is mechanically prevented from being positioned horizontally except in the closed position and the safety switch 22 is connected by wiring 24 to a motor controller 26 in a manner well known in the electrical motor control art to prevent any operation of the motor 20 unless access to the interior of the loading section 12 is prevented.

The motor 20 provides basic power for operating the entire machine 10 through a drive pulley 28. A belt 30 connects the drive pulley 28 to a larger, driven pulley 32 which is mounted on a transfer shaft 34 having a chain drive sprocket 36 on the other end thereof. The drive sprocket 36 is connected by a chain 38 to a larger sprocket 40 which directly drives one of a pair of main shafts 42 and 44. The main shafts 42, 44 are primarily used to cut the containers in a manner which will be explained in detail hereinbelow. They are parallel and mounted for rotation in opposite directions, and in the preferred configuration, the shafts 42, 44 extend horizontally and are located at the same horizontal level within the machine 10. To cause shaft 44 to rotate in the opposite direction of shaft 42 but at the same speed as shaft 42, they are geared together at 46.

The main shafts 42, 44 have sprocket and chain means 48, 50 respectively mounted on the opposite ends thereof in order to be able to transmit corresponding rotation to a pair of feeding shafts 52, 54 of a feeding assist means 55 which will also be discussed in detail hereinbelow. Finally, a single chain and sprocket means 56 is employed to impart rotation to an agitation shaft 58 which supports agitator paddles 60. The rotating agitator paddles 60 are capable of stirring the containers in the loading section 12 to insure they will be properly delivered to the cutting section 14. Although the paddles 60 may be made of sheet metal, it is possible for the outer edges 61 to be partially made of rubber material to insure that the containers will not be entrapped against the interior wall of the loading section 12.

The collecting section 16 is below the cutting section 14 and joined thereto to receive pieces of the disposable containers as they pass by gravity from the cutting section 14. The collecting section 16 is enclosed on three sides but includes a removable basket 61 to collect the pieces for it to be periodically emptied by the machine operators. As thus described, the preferred machine 10 includes dimensions and an arrangement of components which are particularly appropiate for use in grocery and convenience stores.

Figure 4:
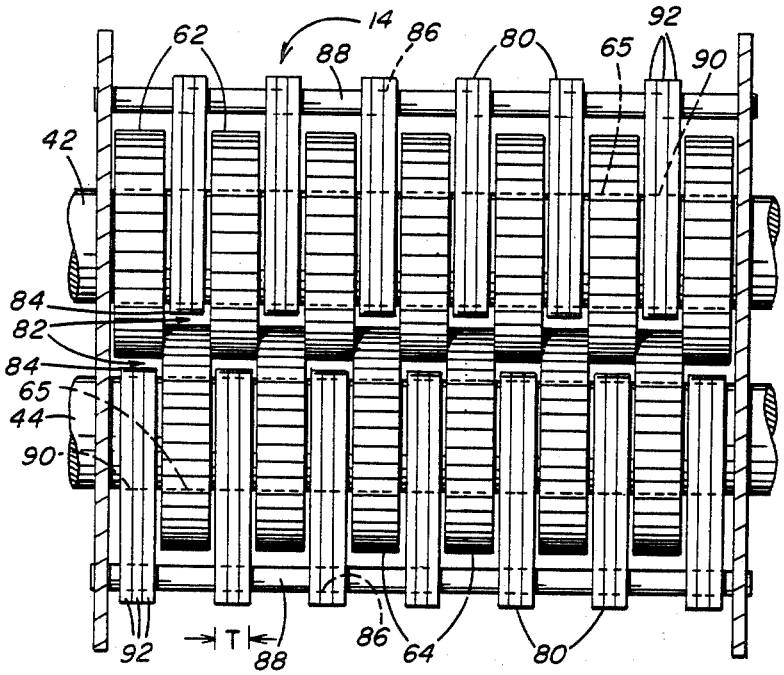
FIG. 4 is a fragmentary top view of the cutting section of the machine of FIG. 1.
Figure 5:
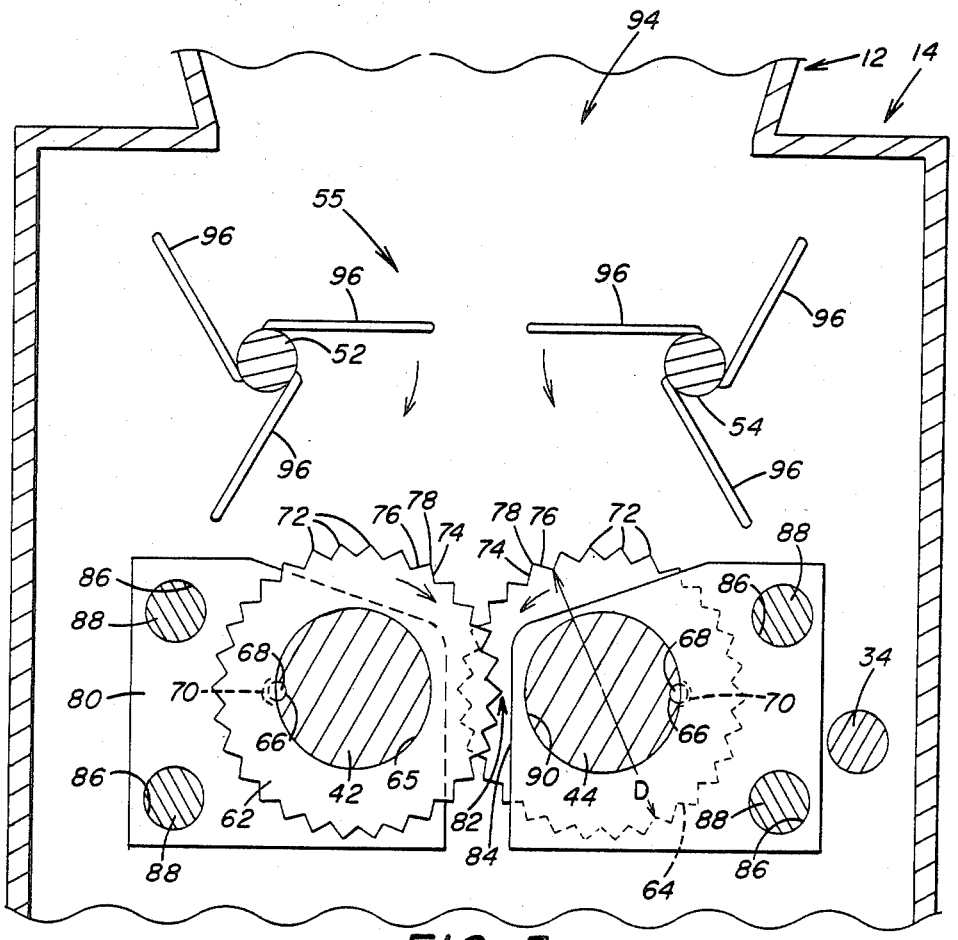
FIG. 5 is simplified end view of the cutting section of FIG. 4 including various features of the invention.

As seen in FIGS. 4 and 5, the preferred cutting section 14, includes a plurality of cutting wheels 62, 64 respectively mounted at holes 65 on the main shafts 42, 44. Each of the preferred cutting wheels is mounted on its circular main shafts at a longitudinal groove 66 by a pair of ball bearings 68. Because of the axial width of each cutting wheel 62, 64, two ball bearings 68 are preferred for each wheel to distribute the load equally between. The ball bearings 68 are installed in the groove 66 and a pair of axially aligned detents 70 provided in the interior wall of hole 65. The detents 70 are relatively easy to provide by inserting a tool at each side of hole 65.

The cutting wheels 62 are axially separated from axially adjacent cutting wheels 62 on the shaft 42 by one of the cutting wheels 64 on the main shaft 44. The cutting wheels 62, 64 are of a design which is different from any of the cutting wheels shown in the prior art machines disclosed in the patents mentioned hereinabove. The cutting wheels include a plurality of evenly spaced cutting teeth 72 with a root diameter D. The main shafts 42, 44 are separated by a distance therebetween which is less than the root diameter D to provide an overlapping of the cutting wheels 62, 64 which includes all of the radial heights of the cutting teeth 72. Further, it should be noted that the preferred cutting teeth 72 are quite simple in form and simple to provide. Specifically, the cutting teeth 72 are identical with a flat leading surface 74 and a flat trailing surface 76 which meet at a straight edge 78 at the outer periphery of the cutting wheel which straight edge 78 is parallel to the shafts 42, 44. The cutting teeth 72 are also equally positioned at the periphery of the wheels as the leading surface 74 and trailing surface 76 intersect a radial line of the cutting wheel through the edge 78 at equal angles. It has been found that such a tooth configuration includes sufficient integrity and well-aligned cutting edges for gripping and cutting sheet plastic and sheet metal material found in disposable containers. Further, the equal positioning of the teeth 72 means that the cutting wheels 62,64 are all interchangable and can be installed either side first on the shafts 42, 44 without affection their effectivness. This feature reduces manufacturing costs and simplifies assembly. However, the interaction of cutting wheels 62, 64 is not expected to do the cutting alone.

The cutting section 14 also includes a plurality of combers 80 which are different from those disclosed in the prior art patents mentioned hereinabove. Each comber 80 is aligned with a corresponding cutting wheel 62, 64 to provide a gap 82 between an end 84 thereof and the cutting teeth 72 of the corresponding cutting wheel 62, 64. Basically, the combers 80 are each mounted at holes 86 on a pair of mounting rods 88 which extend across the cutting section 14. The mounting rods 88 are parallel with and located outwardly of the shafts 42, 44 to cause each comber 80 to extend around one of the shafts 42, 44 at a hole 90 therethrough and between axially adjacent cutting wheels 62, 64 on the shaft 42, 44. As a result, the end 84 of each comber 80 is located at the cutting teeth 72 of the corresponding wheel 64, 62 on the other shaft 44, 42 to provide the gap 82 therebetween. However, it has been found in the preferred machine 10 that the relatively thick comber 80 need not be made of a single, solid metal piece as is required for the cutting wheels 62, 64. To simplify manufacture of the preferred combers 80 and to make them less expensive to provide, the combers 80 have an overall thickness T less than a cutting wheel 62, 64 but are formed of a plurality of thin metal plates 92 in a stacked array to provide the overall thickness T. The plates 92 can be simply and inexpensively stamped from sheet material and may be spot welded if desired to form a more rigid comber 80.

As thus described, the cutting section 14 can be expected to properly cut disposable containers into pieces in various machine arrangements. However, in the preferred machine 10, the feeding assist means 55 is employed to insure each load of disposable containers is completely cut to pieces and to speed up machine operation. The feeding assist means 55 is in an entrance opening 94 of the cutting section 14 and includes the pair of feeding shafts 52, 54 which are centrally disposed above the pair of main shafts 42, 44 and parallel thereto. The feeding shafts 52, 54 each include a plurality of feeding paddles 96 fixedly mounted thereon. Each of the feeding shafts 52, 54 and paddles 96 thereon rotate in the same direction as its adjacent main shaft 42, 44 to cause the paddles 96 to push the disposable containers toward the cutting wheels 62, 64 to be gripped thereby. In the preferred machine 10, the shafts 52, 54 include three paddles 96, rotate at the same speed, and are rotationally aligned to cause each paddle 96 on feeding shaft 52 to pass closely by a corresponding paddle 96 on feeding shaft 54 to be able to entrap the disposable containers therebetween to facilitate the push thereof toward the cutting wheels 62, 64.

In order to fully understand the preferred machine 10, there is additional information which might be of interest. The machine 10 can cut disposable containers including ½, 1 or 2 liter plastic bottles and aluminum or steel cans. The overall height of the machine 10 is about 5½ feet tall. The preferred loading section 12 is about 22" tall with a 24"×24" top opening and a bottom about 8"×13". The preferred cutting section is just over 13" wide to include thirteen cutting wheels 62, 64. Each main shaft 42, 44 has a diameter of about 2⅜ inches. The cutting wheels 62, 64 are one inch wide and have an outside diameter of about 4¾ inches. The root diameter D is about 4¼ inches with a tooth height of ¼ inch. There are 30 evenly-spaced cutting teeth 72 with leading surface 74 being perpendicular to trailing surface 76. The two ball bearings 68 are ¼ inch and installed in two detents 70 which are ⅛ inch deep and respectively centered ¼ inch from each side of the cutting wheel 62, 64. The combers 80 have an overall thickness T of ¾ inches and are made of three ¼ inch sheets of metal. Collecting section 16 is about 2 feet by 2 feet. The pieces cut from the 2-liter plastic bottles are corrugated, about 1 inch wide in various lengths and result in a volume of about ⅓ the volume of the original bottles.

Figures 6, 7:
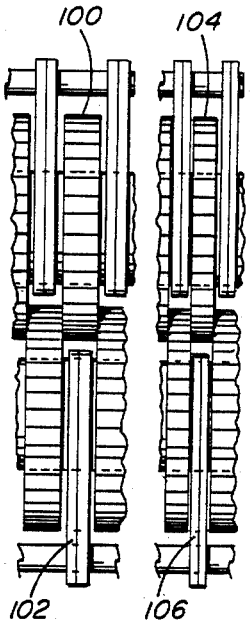
FIG. 6 is a fragmentary top view of an alternative cutting section.
FIG. 7 is a view such as shown in FIG. 6 of another alternative cutting section.

The preferred machine 10 is not the only type of machine in which the general type of components of the cutting section can be employed. For example, if there is a need for a machine at a waste disposal center requiring greater capacity and greater volume savings, the cutting wheel 100 and comber 102 arrangement of FIG. 6 can be used. The cutting wheels 100 have the same teeth and diameter as the wheels 62, 64 but are only ¾ inches wide. The combers 102 are ½ inches thick and made of two ¼ inch sheets of metal. The pieces will be only ¾ inches wide for a waste volume of about ¼ of the original volume. The overall length of such a machine could be increased to about 24 inches for a total of 32 cutting wheels 100 and 32 combers 102. Similiarly, as seen in FIG. 7, similiar cutting wheels 104 could be only ½ inches wide and combers 106 of about ⅜ inches in width could be formed of two 3/16 sheets of metal. The waste volume of such a machine would be about 1/5 of the origional volume.

Clearly, any number of alternatives could be made to the preferred machines without departing from the scope of the invention as claimed.

I claim:

1. A machine capable of cutting into elongated pieces the thin wall material of a plurality of disposable containers such as plastic bottles and metal cans comprising:

a loading section for receiving said plurality of said disposable containers;

a cutting section joined to said loading section and having an entrance opening for receiving said disposable containers therefrom, said cutting section including a pair of parallel shafts mounted for rotation in opposite direction, said pair of shafts each supporting a plurality of cutting wheels keyed for rotation therewith;

each said cutting wheel being mounted for axial movement on one of said shafts and being axially separated from axially adjacent said cutting wheels thereon by one of said cutting wheels on the other of said shafts extending therebetween, each said cutting wheel having a plurality of cutting teeth thereon;

said cutting teeth of said cutting wheels having a root diameter and said pair of shafts being separated by a distance therebetween which is less than said root diameter;

said cutting section including a plurality of combers, each said comber being aligned with a corresponding said cutting wheel to provide a gap between an end thereof and said cutting teeth of said corresponding cutting wheel;

said plurality of said cutting wheels on said pair of shafts being rotated to grip said disposable containers therebetween to cause said disposable containers to be directed between said pair of shafts with said thin wall material of said disposable containers being continuously cut into said elongated pieces having a width generally equal to a width of said cutting wheels with each elongated edge of each elongated piece being cut between side edges of said cutting teeth of one of said cutting wheels on said one shaft and the adjacent side edges of said cutting teeth of an adjacent said cutting wheel on said other shaft as said elongated pieces pass through said gaps between said end of said combers and said cutting teeth of said corresponding cutting wheels;

a collecting section adjoining said cutting section for receipt of said elongated pieces of said plurality of said disposable containers leaving said cutting section; and feeding assist means in said entrance opening of said cutting section including a pair of parallel feeding shafts which are centrally disposed above said pair of said shafts and parallel therewith, said feeding shafts each including a plurality of paddles fixedly mounted thereon with each said feeding shaft and said paddles thereon rotating in the same direction as its adjacent said shaft to cause said paddles to push said disposable containers toward said cutting wheels to be gripped thereby.

2. The machine as set forth in claim 1, wherein said cutting teeth are identical, are evenly spaced about an outer periphery of said cutting wheel, and include a flat leading surface and a flat trailing surface which meet at a straight edge at the outer periphery of said cutting wheel, said straight edge is parallel with said shaft, and said leading surface and said trailing surface intersect a radial line of said cutting wheel at said straight edge at equal angles.

3. The machine as set forth in claim 1, wherein said shaft has a circular cross-section with a longitudinal groove extending its entire length, said cutting wheel has a central circular hole corresponding with said cross-section of said shaft, said interior surface of said circular hole is provided two axially aligned detents, and a ball bearing is installed in each said detent and in said groove when said cutting wheel is mounted on said shafts to key said cutting wheel to said shaft for rotation therewith while allowing axial movement thereon.

4. The machine as set forth in claim 1, wherein each said comber is mounted at at least one hole therethrough on a mounting rod which extends across said cutting section, said mounting rod being parallel with and located outwardly of said one shaft to cause said comber to extend at least partially around said one shaft between said axially adjacent cutting wheels thereon as said end thereof is located at said cutting teeth of said corresponding cutting wheel on said other shaft to provide said gap therebetween.

5. The machine as set forth in claim 4, wherein said comber has an overall axial thickness less than an axial thickness of said cutting wheel.

6. The machine as set forth in claim 5, wherein said comber includes a plurality of thin metal plates in a stacked array to provide said overall axial thickness.

7. The machine is set forth in claim 6, wherein said plurality of thin metal plates are spot welded together to form said stacked array.

8. The machine as set forth in claim 1, wherein said loading section is above said cutting section and said pair of shafts are mounted horizontally at identical horizontal locations.

9. The machine as set forth in claim 8, wherein said collecting section is below said cutting section.

10. The machine as set forth in claim 8, wherein said loading section is generally funnel-shaped to allow gravity supply of said plurality of said disposable containers to said entrance opening of said cutting section.

11. The machine as set forth in claim 10, wherein said loading section includes a closable top to limit access to an interior thereof by operators of said machine.

12. The machine as set forth in claim 11, wherein said closable top includes a safety switch thereon which prevents operation of said machine by said operators unless said closable top is positioned to prevent said access to said interior of said loading section.

13. The machine as set forth in claim 1, wherein said feeding shafts include the same number of said paddles thereon, rotate at the same speed, and are rotationally aligned to cause each said paddle on one said feeding shaft to pass closely by a corresponding said paddle on the other said feeding shaft to entrap said disposable containers therebetween to facilitate said push thereof toward said cutting wheels.

14. The machine as set forth in claim 13, wherein each said feeding shaft includes three radially extending paddles equally spaced thereabout.

* * * * *